United States Patent [19]

Uecker et al.

[11] Patent Number: 4,709,963

[45] Date of Patent: Dec. 1, 1987

[54] ADJUSTABLE OFFICE CHAIR

[75] Inventors: Ronald T. Uecker, Slinger; Steven D. Slicker, Mequon, both of Wis.

[73] Assignee: MILSCO Manufacturing Company, Milwaukee, Wis.

[21] Appl. No.: 940,953

[22] Filed: Dec. 12, 1986

[51] Int. Cl.[4] ..... A47C 1/02

[52] U.S. Cl. ..... 297/316; 297/300; 297/354

[58] Field of Search ..... 297/316, 320, 353, 313, 297/354, 83, 300; 248/575, 576, 577

[56] References Cited

U.S. PATENT DOCUMENTS

| | | | |
|---|---|---|---|
| 2,784,767 | 3/1957 | Soderberg | 297/354 X |
| 3,622,202 | 11/1971 | Brown | 297/354 |
| 4,509,793 | 4/1985 | Wiesmann et al. | 297/316 |
| 4,652,050 | 3/1987 | Stevens | 297/316 X |

*Primary Examiner*—James T. McCall
*Attorney, Agent, or Firm*—James E. Nilles

[57] ABSTRACT

An adjustable office chair (10) comprises a base assembly (12), a seat assembly (14) and a backrest assembly (16). The seat assembly (14) is horizontally rotatable on the base assembly (12) and is raised and lowered thereon by a manually controlled pneumatic actuator (24) connected between the base and seat assemblies (12, 14). The seat assembly (14) comprises a lower seat frame (50) which is mounted on the piston rod (28) of the pneumatic actuator (24) for horizontal rotation and an upper seat frame (52) which is mounted for vertical pivotal movement on the lower seat frame (50). A seat pan (54) is movably mounted on the upper seat frame (52) and is manually movable to selected attitudes wherein it is automatically releasably latched by a mechanism (56). The backrest assembly (16) comprises a lower backrest frame (120) and an upper backrest frame (122) which can be adjustably tilted relative to the lower backrest frame (120) and locked in a selected tilt position by a manually operable tilt lock mechanism (56). The backrest assembly (16) can be forced to a reclining position against spring bias of biasing springs (76) as the chair occupant leans backward and such backrest reclining motion is accompanied by proportional rearward and downward sloping motion of the upper seat frame (52) of the seat assembly (14). A manually adjustable linkage (94, 95, 100) adjusts the amount of spring biasing force acting on the upper seat frame (52) and on the backrest assembly (16) during such reclining motion. A manually controlled lockout mechanism (171, 172) selectively prevents or permits such reclining motion.

22 Claims, 18 Drawing Figures

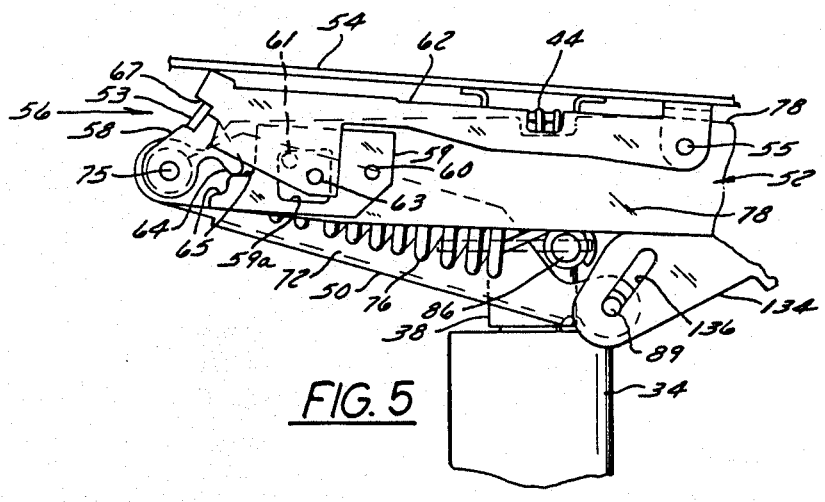
FIG. 5
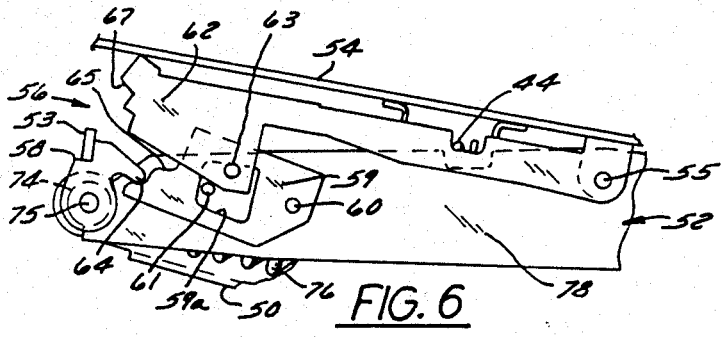
FIG. 6
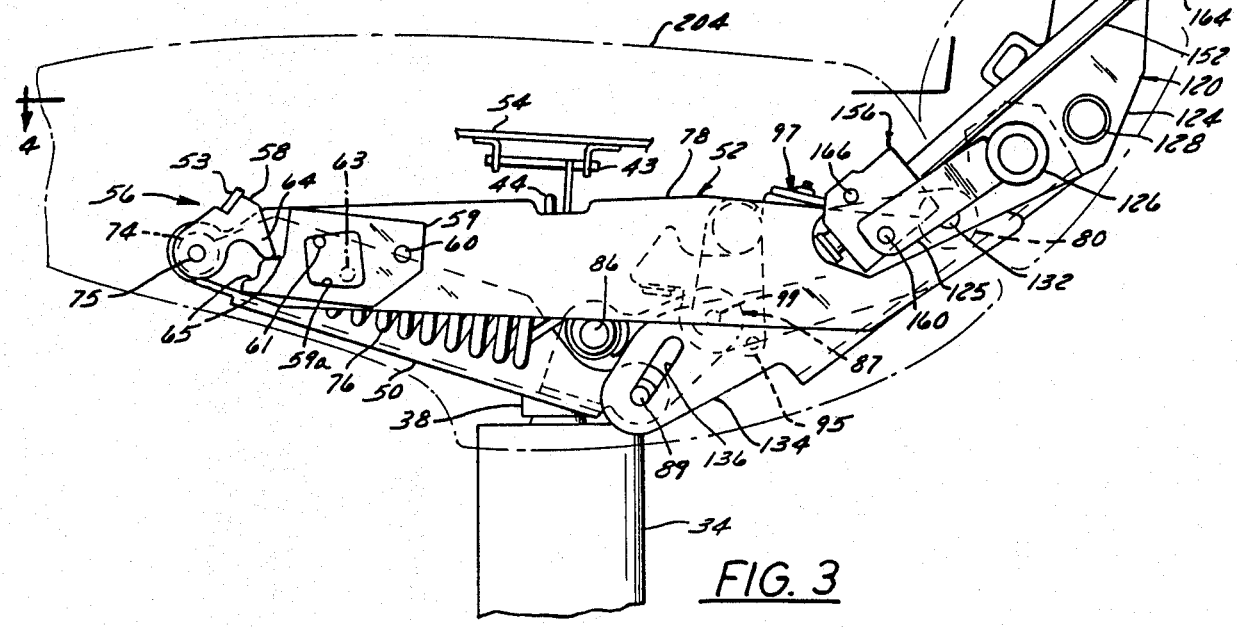
FIG. 3
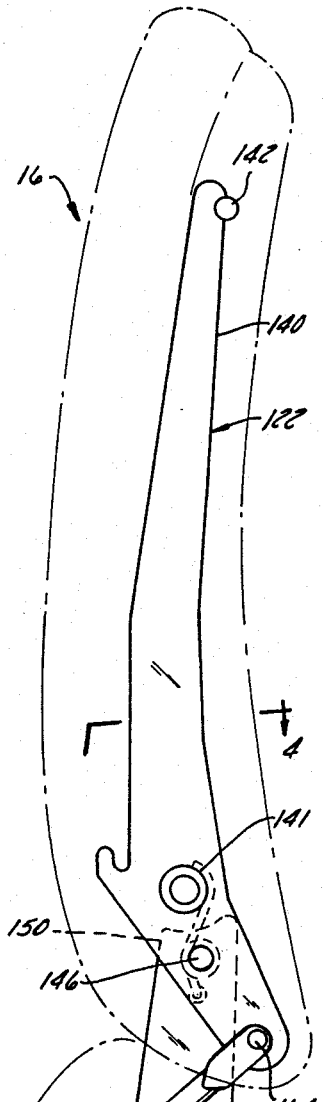

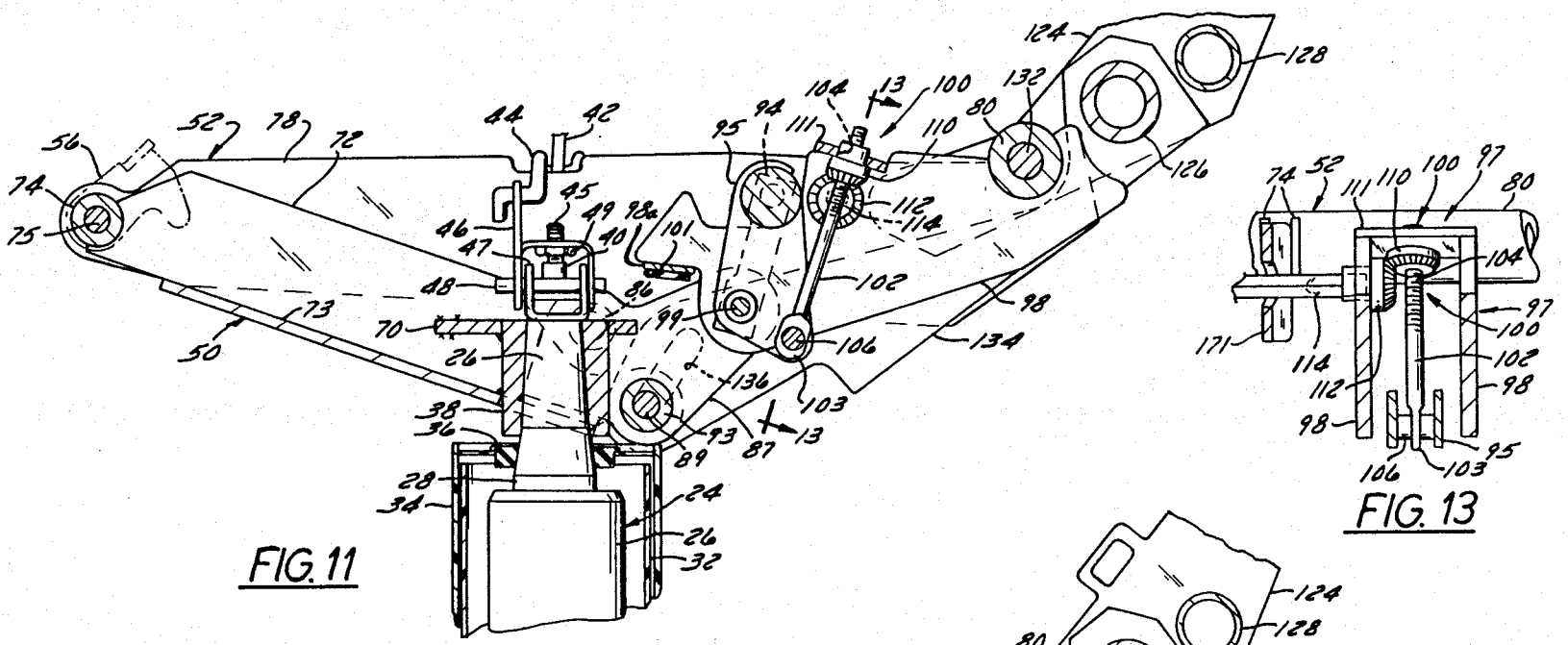
FIG. 11
FIG. 13
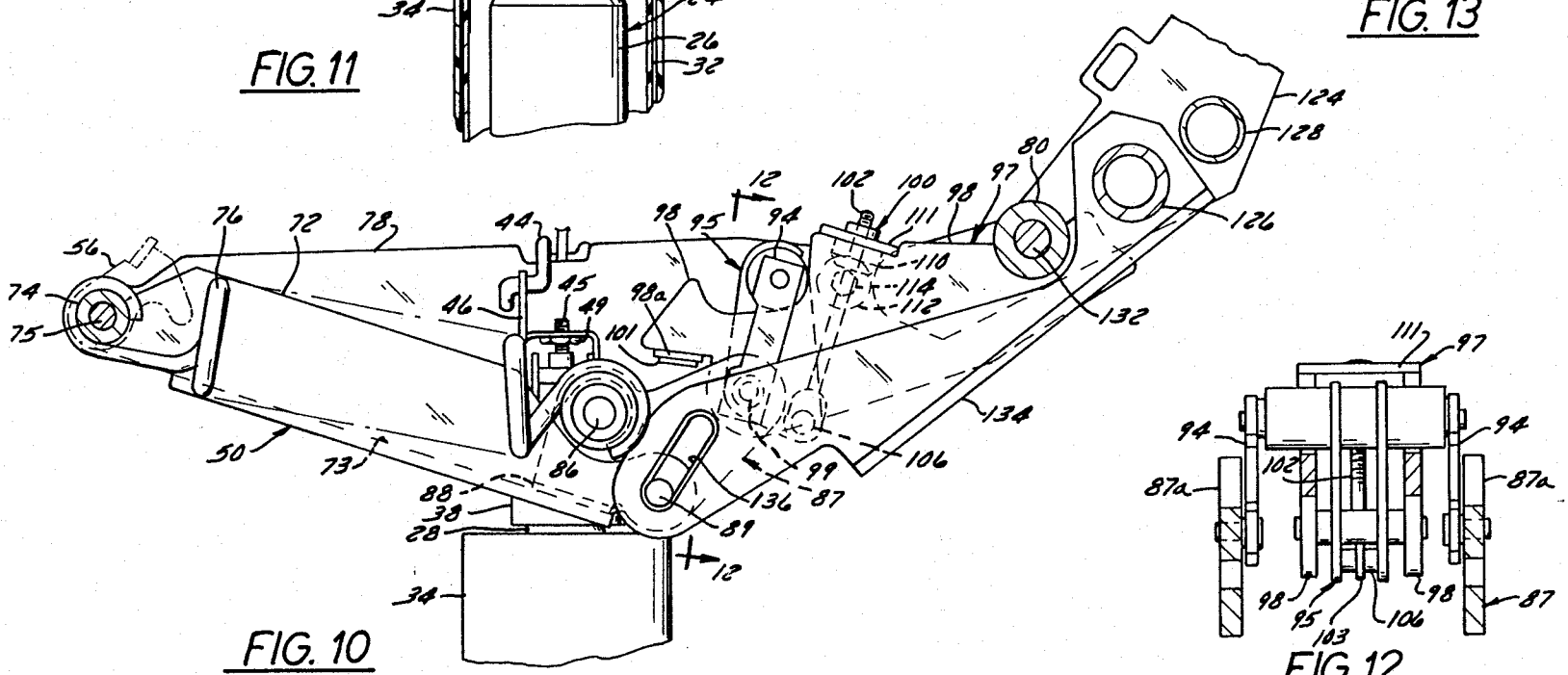
FIG. 10
FIG. 12

ADJUSTABLE OFFICE CHAIR

BACKGROUND OF THE INVENTION

1. Field of Use

This invention relates generally to adjustable office chairs and, in particular, to improved mechanisms for effecting and controlling backrest reclining motion and for effecting selective adjustment of seat height, seat attitude and backrest attitude.

2. Description of the Prior Art

The prior art discloses numerous versions of adjustable office chairs and adjusting mechanisms therefor. In some office chairs, the seat and backrest are rigidly secured together relative to each other and are mounted on a chair base. The seat and fixed backrest are biased into a standard position by biasing springs but can be tilted backward together to a reclining position on the chair base against spring bias by the chair occupant as he leans back. Typically, no adjustable tilt positioning of the backrest relative to the seat is possible in such a chair. Some prior art chairs employ a valve-controlled pneumatic seat height adjustment mechanism as shown in U.S. Pat. No. 3,711,054 to Bauer, issued Jan. 16, 1973.

SUMMARY OF THE INVENTION

An adjustable office chair in accordance with the invention comprises a base assembly, a seat assembly and a backrest assembly.

The base assembly comprises castered legs which extend radially outwardly from a central hub and a pneumatic actuator, including an axially movable piston rod and a selectively operable control valve, is mounted on the hub and connected to the seat assembly to raise and lower the seat assembly. A manually operable valve control mechanism is provided on the seat assembly to operate the control valve.

The seat assembly comprises a rigid lower seat frame which is mounted for horizontal rotation on the upper end of the piston rod. The seat assembly also comprises an upper seat frame which is mounted for vertical pivotal movement to rearwardly sloped positions on the lower seat frame. The seat assembly further comprises a seat pan which is mounted for vertical pivotal movement up or down to tilted attitudes on the upper seat frame. A seat pan latch mechanism is connected between the upper seat frame and seat pan and operates to releasably latch the seat pan in any one of three tilt attitudes to which the seat pan is manually moved.

The backrest assembly comprises a lower backrest frame which is pivotally mounted on the rear end of the upper seat frame to enable reclining motion. The backrest assembly also comprises an upper backrest frame which is pivotally mounted for rotational fore and aft movement to desired attitudes on the lower backrest frame. A manually operable backrest tilt locking mechanism is connected between the lower and upper backrest frames and is manually operable to releasably lock upper backrest frame relative to the lower backrest frame at a selected tilt angle.

Means are provided for enabling and controlling reclining motion of the chair and operate to bias the upper seat frame (and seat pan mounted thereon) and the lower backrest frame (and upper backrest frame mounted thereon) to an upright position when the chair is unoccupied. These means also enable the chair occupant to force the backrest assembly and the upper seat frame to reclining positions against spring bias as the occupant leans backward. During such reclining motion the backrest assembly and upper seat frame move angularly simultaneously and at different but proportional rates relative to each other. For example, in the chair disclosed herein the upper seat frame can move between 0° (level) and a maximum 10° downward slope relative to the rigid lower seat frame, whereas the lower backrest frame (and upper backrest frame affixed thereto) can move between 0° (upright) and a maximum 18° rearward reclining position relative to the rigid lower seat frame and thus moves in proportion to the angular movement of the upper seat frame. However, lesser or greater degrees of angular travel can be provided for by appropriate design and construction of the chair.

The means for enabling and controlling such reclining motion comprise a bell crank pivotally mounted on the rear of the lower seat frame, at least one pre-loaded biasing spring (but preferably two) connected between the front end of the lower seat frame and one arm of the bell crank, a movable linkage, including two links, connected between the other arm of the bell crank and the rear end of the upper seat frame, and means for slidably and pivotally connecting a downwardly depending member on the lower backrest frame (which is pivotally connected to the rear of the upper seat frame) to the lower seat frame at or near the pivot point of the bell crank. Spring bias is thus transmitted through the bell crank and through the movable linkage to the upper seat frame and from there to the lower backrest frame. The depending member effects proportional angular reclining movement of the upper seat frame and the lower backrest frame.

A selectively operable spring bias force adjustment mechanism is provided in the movable linkage between the bell crank and the upper seat frame to selectively adjust the amount of force needed to be applied by the seat occupant during proportional reclining motion of the backrest assembly and upper seat frame against spring bias. This mechanism enables repositioning of the aforesaid two links relative to the bell crank to change the effective moment arm and stroke of the bell crank, thereby increasing or decreasing the spring biasing force acting on the upper seat frame and the backrest framework without changing the initial preloading of the biasing springs, therefore reducing the manual force required to adjust the spring biasing. The spring biasing force adjustment mechanism is manually operable by a rotatable knob on a side of the seat assembly.

A manually controlled lockout mechanism connected between the upper seat frame and bell crank is selectively operable to prevent reclining motion by means of a rotatable knob mounted on the spring force adjustment mechanism.

The several manual controls for effecting height adjustment, seat pan attitude adjustment, backrest attitude adjustment, biasing force adjustment, and reclining motion lockout are conveniently located along the lower lateral sides of the chair.

An office chair in accordance with the present invention offers numerous advantages over the prior art. For example, the chair is provided with more adjustment capability than prior art office chairs presently available. Raising and lowering of the seat assembly (and attached backrest assembly) is accomplished by means of the pneumatic actuator whenever its control valve is opened by manual manipulation of the control lever mounted on a side of the seat assembly. The seat pan in the seat assembly can be moved up or down to a desired tilt position or attitude simply by grasping and vertically moving the front edge of the seat pan, whereupon the seat pan is automatically releasably latched in the selected position. The upper backrest frame can be manually rotated fore and aft relative to the lower backrest frame to a desired attitude and releasably locked therein simply by manipulation of a control lever located on a side of the backrest assembly. The backrest assembly and the seat assembly can be temporarily moved simultaneously to reclining positions when the chair occupant leans backward against the force of the biasing springs. To enhance comfort, such reclining motion is accompanied by proportional downward sloping movement of the upper seat frame (and attached seat pan) and rearward movement of the backrest assembly. The force required to effect reclining motion can be adjusted by the occupant's manipulation (rotation) of a control knob located on a side of the seat assembly. If preferred, reclining motion can be prevented by the chair occupant by the occupant's manipulation of a lever mounted on the aforesaid control knob. In the embodiment disclosed, the armrests for the chair can be detached, if desired, and different styles of armrests can be provided. The supporting framework of the chair and operating mechanisms are concealed from view and protected by rigid fiberglass or plastic covers and upholstery which are shaped and colored for desired aesthetic effects. All manual controls are readily accessible to the seat occupant but are substantially concealed from view. Other objects and advantages of the invention will hereinafter appear.

DRAWINGS

FIG. 3 is an enlarged side elevation view of the seat and backrest assemblies of the chair taken on line 3—3 of FIG. 4;

FIG. 5 is a side elevation view of the seat assembly taken on line 5—5 of FIG. 4 and showing the seat pan thereof in its intermediate latched position;

FIG. 6 is a view similar to FIG. 5 but taken on line 6—6 of FIG. 4 and showing the seat pan moved upwardly from its highest latched position to effect latch release;

FIG. 10 is an enlarged side elevation view, partly in section, taken on line 10—10 of FIG. 4;

FIG. 11 is a view similar to FIG. 10, but taken on line 11—11 of FIG. 4;

FIG. 12 is a cross-section view taken on line 12—12 of FIG. 10;

FIG. 13 is a cross-section view taken on line 13—13 of FIG. 11;

DESCRIPTION OF A PREFERRED EMBODIMENT

Figures 1, 2:
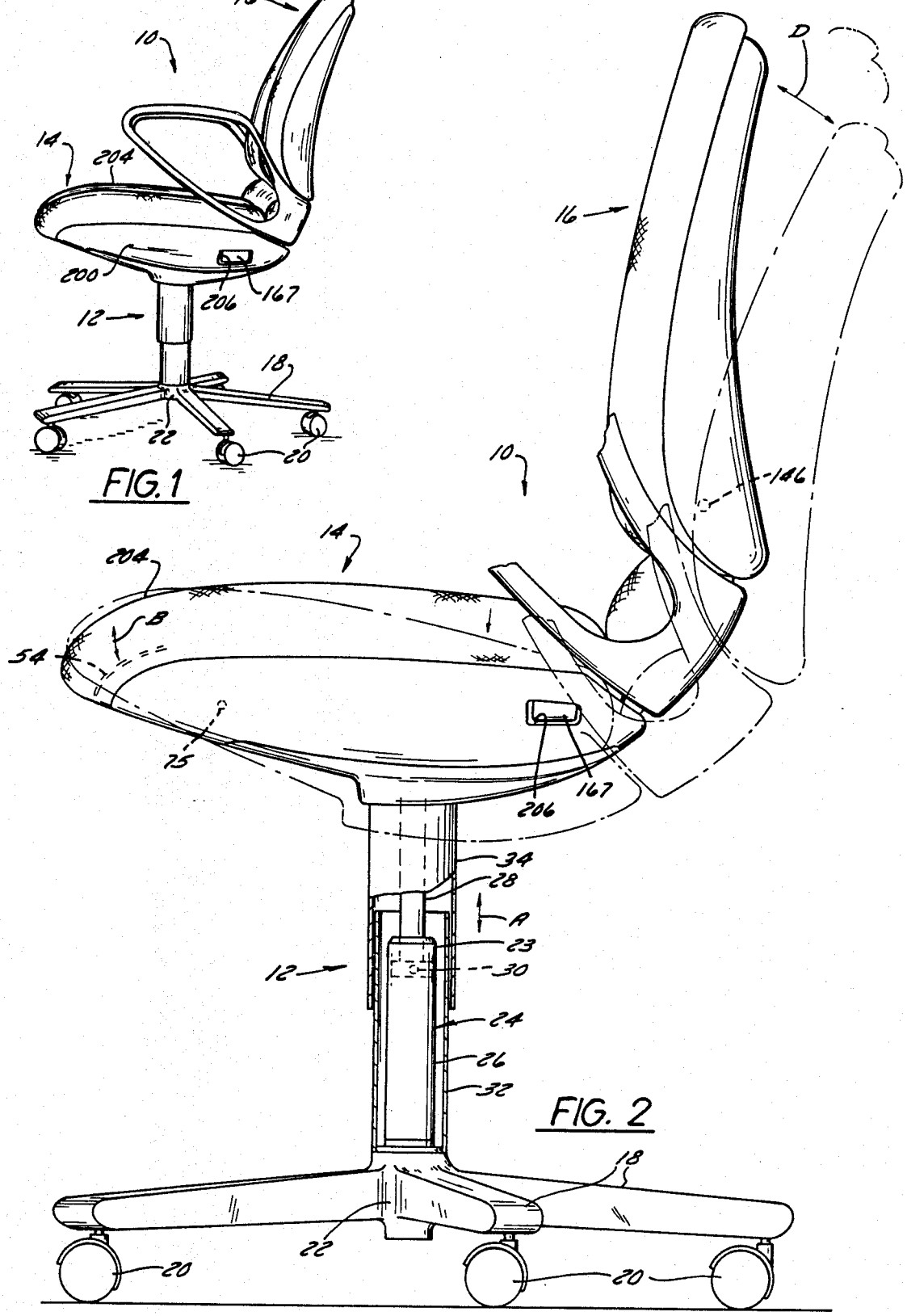
FIG. 1 is a perspective view of an adjustable office chair in accordance with the invention.
FIG. 2 is an enlarged side elevation view of the chair and showing the seat and backrest assemblies thereof in their upright positions (solid lines) and in their extreme reclining positions (broken lines)

FIGS. 1 and 2 show an adjustable office chair 10 in accordance with the invention which comprises a base assembly 12, a seat assembly 14 and a backrest assembly 16.

BASE ASSEMBLY AND PNEUMATIC ACTUATOR

Base assembly 12 comprises a plurality of radially extending legs 18 having casters 20 thereon and joined together at a central hub 22.

A pneumatic actuator 24, which is a commercially available component and is disclosed in aforementioned U.S. Pat. No. 3,711,054, is provided to adjust the height of seat assembly 14 (and backrest assembly 16 attached thereto) and comprises a cylinder 26 mounted on hub 22, a piston 23 slidably mounted in the cylinder, a vertically extending axially movable piston rod 28 connected to the piston, and a control valve 30 mounted on piston 23. A tubular column 32 is mounted on hub 22 and surrounds actuator 24 and a sleeve 34 mounted on piston rod 28 telescopically receives column 32. Seat assembly 14 is mounted on base assembly 12 (i.e., on piston rod 28) so that the seat assembly can be rotated in either direction in a horizontal plane by a seat occupant and so that the seat assembly can be raised and lowered vertically (arrow A, FIG. 2) relative to the base assembly to a desired height with the aid of actuator 24 when valve 30 is opened. As FIG. 11 shows, the upper end of piston rod 28 is tapered and sleeve 34, which telescopically receives column 32 on hub 22, is supported thereon by means of a rubber ring 36. The tapered end of piston rod 28 extends through a collar 38 which is rigidly secured to a lower seat frame 50, hereinafter described, of seat assembly 14 and is rigidly secured to collar 38 by a taper fit.

Piston rod 28 has a passage (not shown) which extends axially therethrough and accommodates a valve stem 40 which is axially movable to operate (open and close) control valve 30 within cylinder 26. Actuator 24 is preloaded with compressed gas so that piston rod 28 is normally biased upwardly. Selectively operable, normally closed control valve 30, when open, causes piston rod 28 to extend and move seat assembly 14 upward, if the chair is unoccupied. Opening valve 30 also enables seat assembly 14 and piston rod 28 to be forced downward against the force of the compressed gas under the weight of the chair occupant. Control valve 30, when closed, maintains seat assembly 14 at a desired height.

Figure 4:
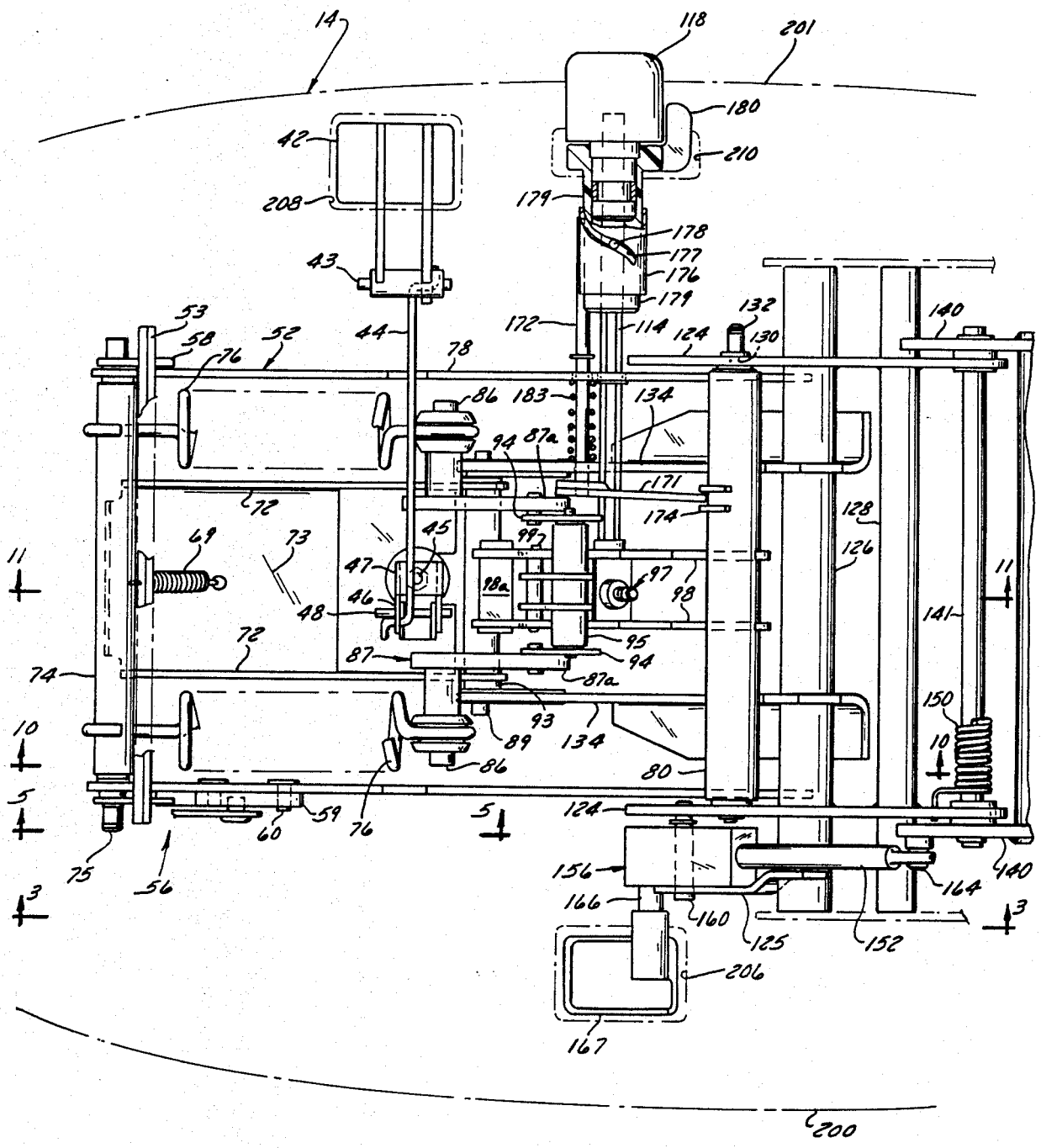
FIG. 4 is a top plan view, with portions broken away, of the seat assembly and a portion of the backrest assembly taken on line 4—4 of FIG. 3.
Figure 16:
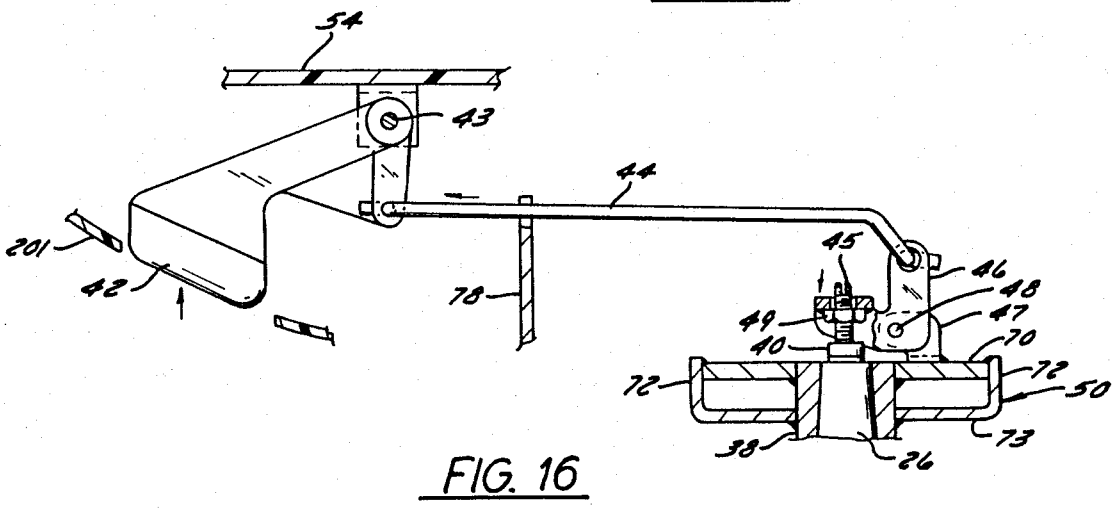
FIG. 16 is a side elevation view, partly in cross section, of the valve control mechanism shown in top plan view in FIG. 4 and employed to enable raising and lowering the seat assembly.

FIGS. 4 and 16 show that a manually operable valve control mechanism, including a member or lever 42 is provided for operating (opening and closing) valve 30. As FIGS. 4, 11 and 16 best show, seat height adjustment lever 42 is in the form of a first bell crank which is pivotally mounted by a pivot pin 43 on the underside of a seat pan 54 in seat assembly 14. The other arm of bell crank 42 is pivotally connected to one end of an axially shiftable control rod 44. The other end of control rod 44 is pivotally connected to one arm of a second bell crank 46 which is pivotally mounted by a pivot pin 48 to a bracket 47 which is rigidly secured as by welding to collar 38 on the framework of seat assembly 14. The other arm of second bell crank 46 carries a plate on which is secured a nut 49 and an adjustment screw 45 in nut 49 engages the end of valve stem 40 which is biased thereagainst. When valve stem 40 is raised (as shown in FIG. 16), the valve is closed and seat assembly 14 cannot be raised or lowered. When lever 42 is depressed (moved clockwise in FIG. 16), rod 44 shifts leftward, second bell crank 46 moves counterclockwise, stem 40 moves downward and valve 30 is opened. With the valve 30 open, seat assembly 14 can be raised or lowered to any height at or between its extreme upper and lower limits of travel. When lever 42 is released, valve 30 closes and seat assembly 14 is maintained at whatever height it is at.

SEAT ASSEMBLY AND LOADING SPRINGS

Figure 7:
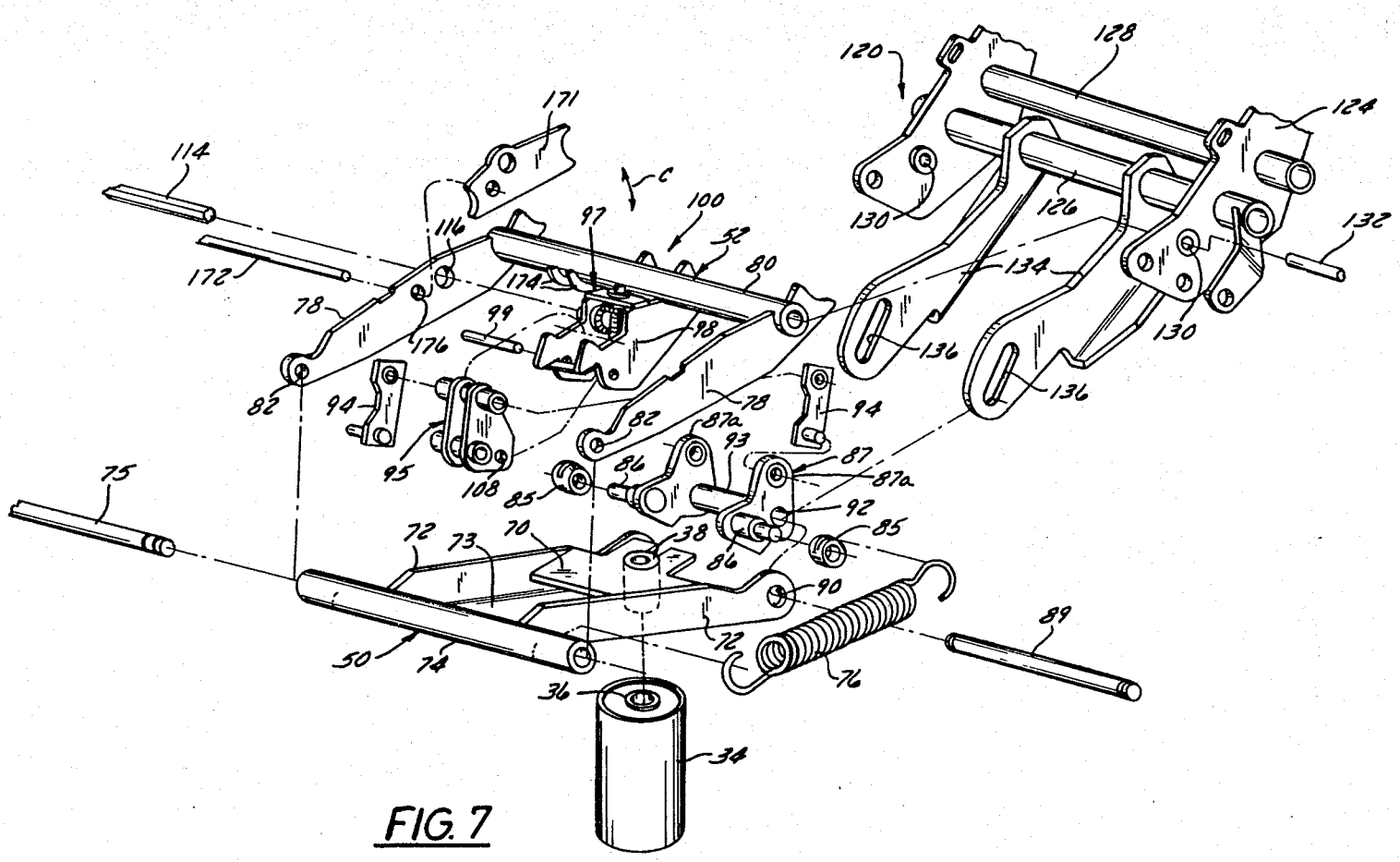
FIG. 7 is an exploded perspective view, with certain elements omitted, of the seat assembly and a portion of the backrest assembly.

Referring to FIGS. 2, 3, 4 and 7, seat assembly 14 comprises a seat framework including a lower seat frame 50 mounted for horizontal rotation on piston rod 28 and a movable upper seat frame 52 pivotally mounted on lower seat frame 50 for movement in the direction of arrow C (FIG. 7). A seat pan 54 is pivotally mounted on upper seat frame 52 for pivotal movement up or down manually in the direction of arrow B (FIG. 2) to any one of a plurality of seat pan attitudes by pivot pins 55.

FIGS. 3, 4, 5 and 6 show a ratchet type latch mechanism 56 connected between upper seat frame 52 and seat pan 54 and which operates in response to manual raising or lowering of the front end of seat pan 54 to automatically releasably latch the seat pan in selected attitudes. A mechanism similar to mechanism 56 is disclosed in detail in U.S. patent application Ser. No. 912,495, filed Sept. 29, 1986, by Kevin E. Hill for "Self-Releasing Ratchet-Type Seat Adjustment", and assigned to the same assignee as the present application. Seat pan 54 can assume three latched positions, namely, lowest, intermediate and highest latched positions and can be moved upward from the highest latched position to release the latch and allow the seat pan to be moved down to its lowest position. FIG. 5 shows seat pan 54 latched in its intermediate position and FIG. 6 shows the seat pan manually raised above its highest latched position to effect the release of latch mechanism 56 and enable the seat pan to be returned to its lowermost position from which it can be raised to intermediate and highest attitudes.

Latch mechanism 56 generally comprises a pair of pawls 58 which are rotatably mounted on the projecting ends of rod 75. FIG. 4 shows that the pawls are interconnected by a rigid bar 53. Mechanism 56 also comprises a single latch plate 59 which is pivotally connected by a pin 60 to the front end of the occupant's left side plate 78 of upper seat frame 52. Each pawl 58 is biased in a clockwise direction (relative to FIGS. 3, 5 and 6) by a biasing spring 69 shown in FIG. 4. Latch plate 59 is provided with an opening 59A which receives a pin 61 which is connected to a side arm 62 of left side plate 78 and limits travel of latch plate 59. Left seat pan side arm 62 carries a latch pick-up pin 63 which extends into opening 59A and operates to raise plate 59 (see FIG. 6) to thereby rotate pawl 58 counterclockwise (FIG. 6) so that seat pan 54 can be moved toward its lowest position. During such movement, the projection 64 on pawl 58 engages the upper step 65 on plate 59 (FIG. 3) and the seat pan assumes its lowest position. Pawl 58 comprises a projection 64 which releasably engages either of two ratchet teeth 65 on latch plate 59. The rigid bar 53 connected to each pawl 58 is releasably engageable either of two steps 67 on the end of seat pan side arm 62 and is also releasably engageable with the underside of seat 54. Seat pan 54 can be raised from its lowest latched position to the intermediate latched position, and to its highest latched position. When seat pan 54 is elevated above its higher latched position, projection 64 of pawl 58 is caused to drop down from higher step 65 (FIG. 5) to lower step 65 (FIG. 6).

Referring to FIGS. 4 and 7, lower seat frame 50 comprises a center plate 70 on which collar 38 is rigidly mounted. A pair of laterally spaced apart side arms 72 are rigidly secured as by welding to center plate 70. A plate 73 is welded between the side arms 72 below center plate 70. A front tube 74 is rigidly secured as by welding to the front ends of the side arms 72. Tube 74 accommodates a rod 75 on which upper seat frame 52 is pivotally mounted. One end of each of a pair of helical tension type biasing springs 76 are anchored to the projecting ends of tube 74. Upper seat frame 52 comprises a pair of laterally spaced apart side arms 78 which are rigidly secured as by welding at their rear ends to a rear tube 80. The side arms 78 have holes 82 which pivotally receive the projecting ends of rod 75 so that upper seat frame 52 can pivot up or down on rod 75 in the direction of arrow C (FIG. 7) relative to lower seat frame 50 between a nominal level (0°) position and a maximum downwardly and rearwardly sloped position wherein it is displaced an angular distance of about 10° (compare the two positions of tube 80 in FIG. 14). Upper seat frame 52 pivots or slopes downwardly a few degrees (about 3°) under the weight of the chair occupant but slopes downwardly even further (up to the maximum of 10°) when backrest assembly 16 is subjected to a rearward reclining force by the occupant (up to a maximum of 18°), as will hereinafter appear.

An upward spring biasing force is applied to upper seat frame 52 by the pair of preloaded biasing springs 76. As previously mentioned, the front end of each biasing spring 76 is anchored to tube 74. The rear end of each spring 76 is connected to a rotatable bushing 85 on a pin 86 which is mounted on one arm of a bell crank 87. Bell crank 87 comprises two laterally spaced apart plates 8A which are joined by a tube 93 welded therebetween. Bell crank 87 is pivotally mounted at the rear ends of the side arms 72 of lower seat frame 50 by means of a pivot rod 89. Rod 89 extends through holes 90 in the arms 72 and through a hole 92 in tube 93 in bell crank 87. The springs 76 tend to bias bell crank 87 counterclockwise (with respect to FIG. 7). A resilient (rubber) upstop 88 on the said one arm of bell crank 87 engages plate 73 on lower seat frame 50 when the chair is unoccupied to limit upward movement of upper seat frame 52. The other arm of bell crank 87 is connected by a movable linkage which opposes the spring bias and comprises a pair of links 94, a small crank 95, and a spring tension adjustment mechanism 97 mounted on tube 80 of upper seat frame 52. Mechanism 97 comprises a pair of laterally spaced apart side plates 98 welded to tube 80 and a manually operable gear assembly 100, hereinafter described. Each link 94 is pivotally connected one end to the said other arm of bell crank 87 and is pivotally connected at its other end to one arm of crank 95. Crank 95 is pivotally mounted on the side plates 98 of mechanism 97 by means of a pin 99. Crank 95 is adjustably pivotable on the side plates 98 by gear assembly 100 to effect repositioning of the links 94 and 95. Repositioning of links 95 and 94 relative to bell crank 87 changes the effective moment arm and stroke of bell crank 87 thereby increasing or decreasing the spring biasing force acting on upper seat frame 52 and on backrest framework of backrest assembly 16 without changing the initial preloading of the springs 76, thereby reducing the force required to adjust the spring biasing. A resilient (rubber) downstop 101 on a cross-member 98A rigidly secured between the side plates 98 engages the bell crank tube 93 to limit maximum downward pivoting movement of upper seat frame 52.

Figures 14, 15:
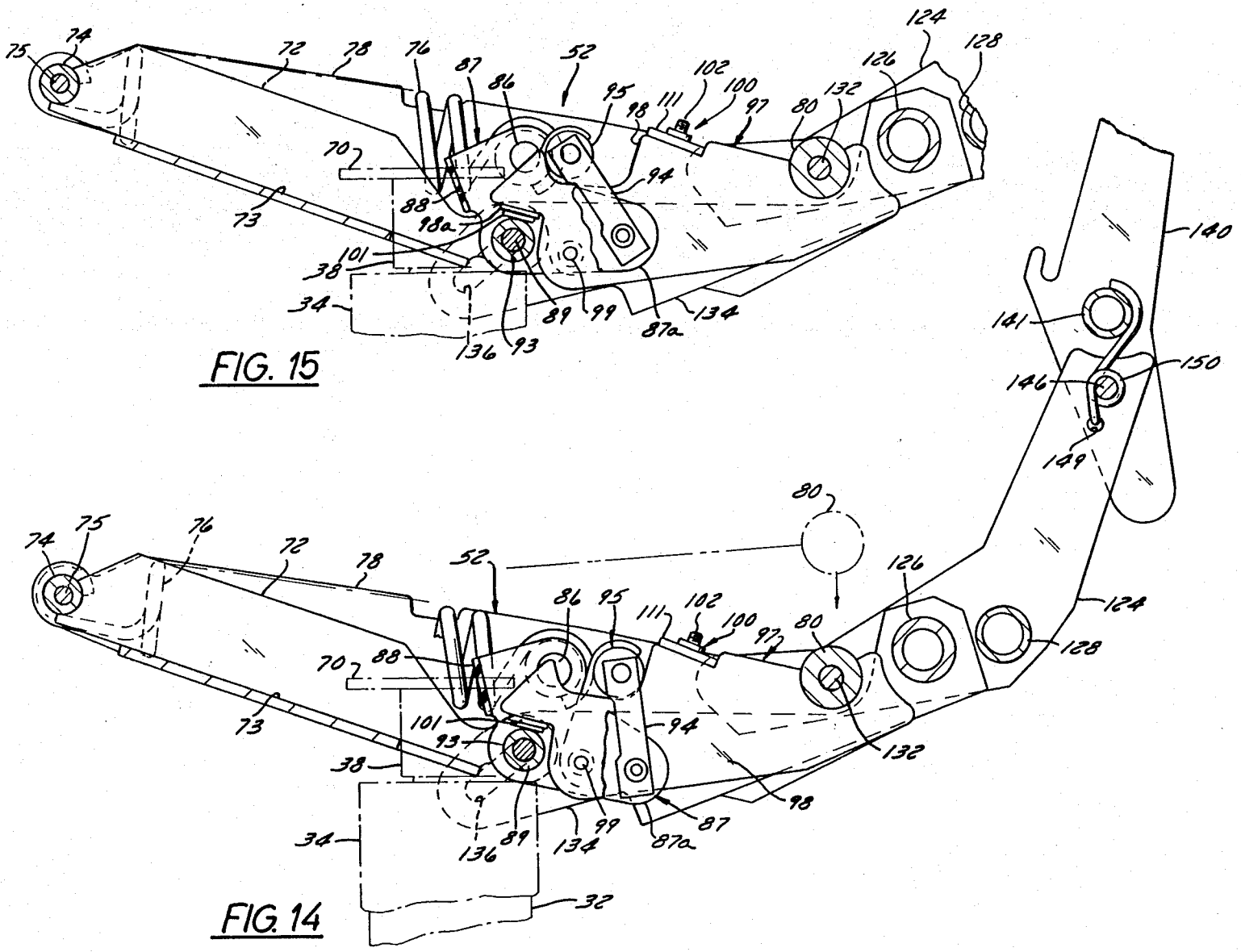
FIG. 14 is a view similar to FIG. 10 but showing the upper seat frame of the seat assembly in a lowered position it would assume under the weight of a chair occupant and with the force adjustment mechanism adjusted to enable the springs to exert the heaviest force.
FIG. 15 is a view similar to FIG. 14 but showing the force adjustment mechanism adjusted to enable the springs to exert the lightest force.

As FIGS. 4, 7, 10, 11, 12 and 13 show, gear assembly 100 comprises a rotatable threaded adjustment screw 102 which threadedly engages a threaded hole 104 in an upper bevel gear 110 hereafter described. Screw 102 has an eye 103 at its end which receives a small pin 106 which is fixedly mounted in the holes 108 in the said other arm of crank 95. First or upper bevel gear 110 is rotatably mounted on an end plate 111 which is rigidly affixed to the side plates 98. Bevel gear 110 meshes with a second bevel gear 112 which is rigidly affixed to the inner end of a rotatable rod 114. Rod 114 is rotatably mounted in a hole 116 in one of the side arms 78 of upper seat frame 52 and has a knob 118 at its outer end whereby manual rotation of rod 114 is effected to adjust effective spring biasing force. FIGS. 14 and 15 show the position of the links 94, crank 95 and a bell crank 87 when adjustment screw 102 of spring bias force adjustment mechanism 97 is in lightest and heaviest force positions, respectively. FIGS. 10 and 11 also show these components in heaviest force position.

Backrest Assembly

Figure 8:
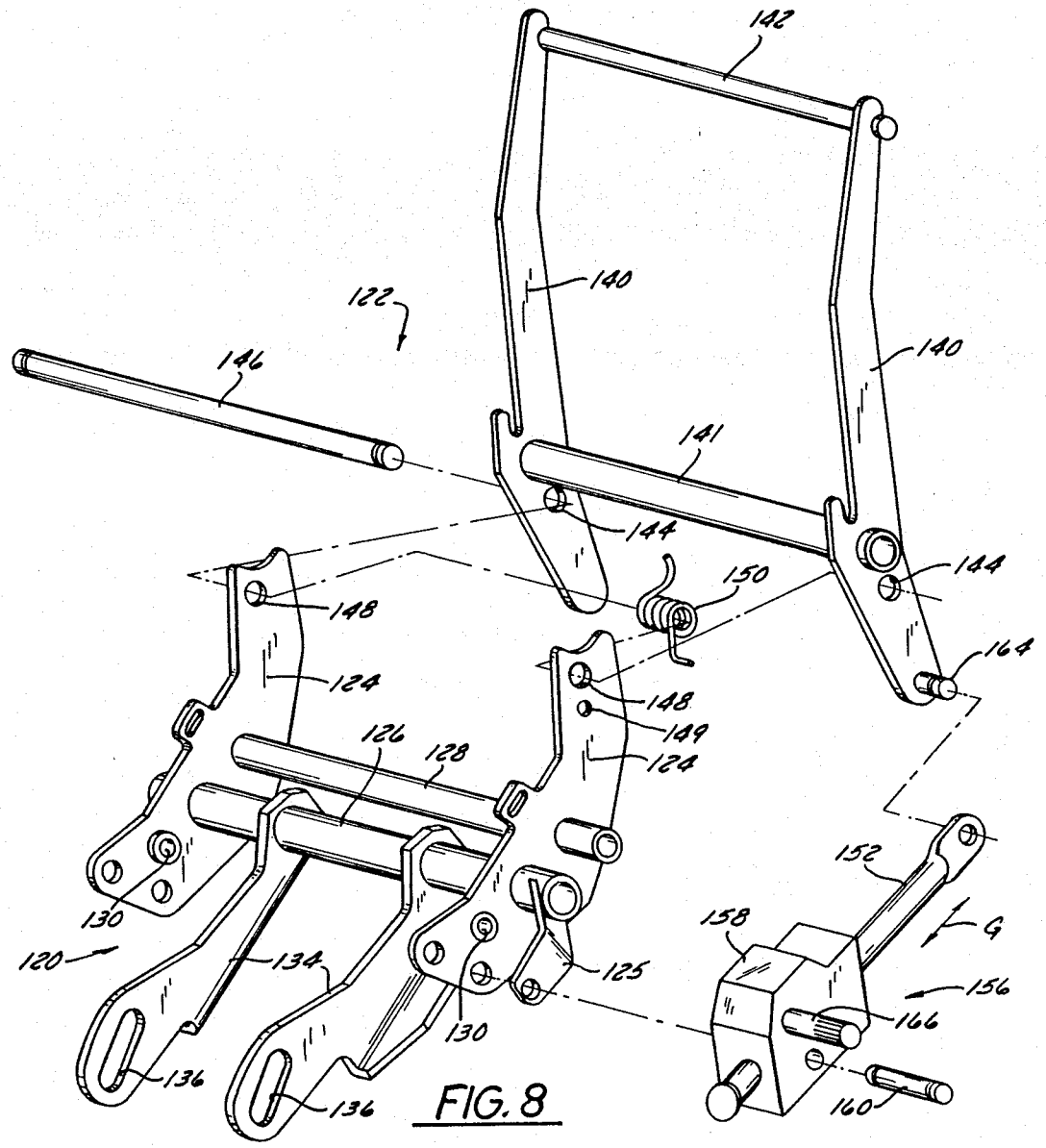
FIG. 8 is an exploded perspective view, with certain elements omitted, of the framework of the backrest assembly shown in FIGS. 3 and 4.
Figure 9:
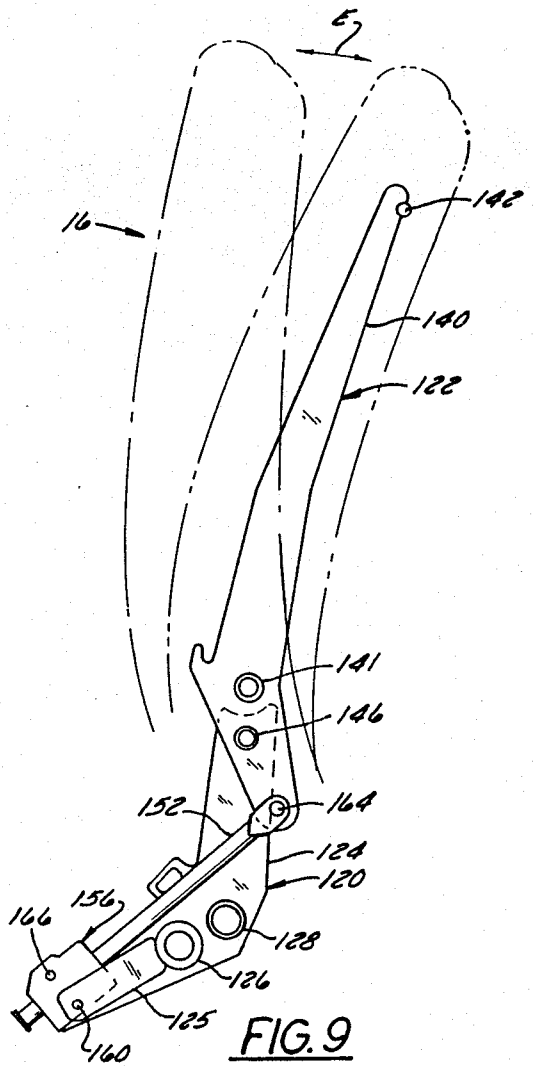
FIG. 9 is a side elevation view of the backrest framework of FIG. 8 and showing its most upright attitude and an alternative tilt position.

Referring to FIGS. 7 and 8, backrest assembly 16 comprises a backrest framework including a lower backrest frame 120 and an upper backrest frame 122. Lower backrest frame 120 comprises a pair of laterally spaced apart side plates 124 which are rigidly secured together by a pair of rigid tubular members 126 and 128 which are welded between the side plates 124 and have outwardly projecting ends. Each side plate 124 is provided with a hole 130 which enables lower backrest frame 120 to be pivotally connected, as by a pivot rod 132, to tube 80 of upper seat frame 52. Lower backrest frame 120 further comprises a pair of laterally spaced apart downwardly depending members or legs 134 which are rigidly secured as by welding to tubular member 126. Each leg 134 is provided with an elongated slot 136 which slidably and pivotably receives and engages the ends of pivot pin 89 of bell crank 87. The foregoing arrangement enables lower backrest frame 120 to incline or tilt rearwardly in the direction of arrow D (FIG. 2) and the upper seat frame 52 to slope downwardly and rearwardly in the direction of arrow C (FIG. 7), both moving at proportional rates and against spring bias under the force imposed by the chair occupant.

As previously mentioned, means are provided for enabling and controlling reclining motion of chair 10 and operate to bias upper seat frame 52 (and seat pan 54 mounted thereon) and lower backrest frame 120 (and upper backrest frame 122 mounted thereon) to an upright position when the chair is unoccupied. These means also enable the chair occupant to force the backrest assembly (comprising backrest frames 120 and 122) and upper seat frame 52 to a reclining position against spring bias as the occupant leans backward. During such reclining motion the backrest assembly (frames 120 and 122) and upper seat frame 52 move angularly simultaneously and at different but proportional rates relative to each other. For example, upper seat frame 52 can move between 0° (level) and a maximum 10° downward slope relative to rigid lower seat frame 50, whereas lower backrest frame 120 (and upper backrest frame 122 affixed thereto) can move between 0° (upright) and a maximum 18° rearward tilt position relative to rigid lower seat frame 50 and thus moves in proportion to the angular movement of upper seat frame 52.

The means for enabling and controlling such reclining motion include previously described bell crank 87 pivotally mounted on the rear of lower seat frame 50, the biasing springs 76 connected between the front end of lower seat frame 50 and one arm of bell crank 87, the movable linkage connected between the other arm of bell crank 87 and the rear end of upper seat frame 52, and the means for slidably and pivotally connecting downwardly depending member or leg 134 on lower backrest frame 120 (which lower backrest frame 120 is pivotally connected to the rear of upper seat frame 52) to lower seat frame 50 at or near the pivot point 90 of bell crank 87. Spring bias is thus transmitted from springs 76, through bell crank 87 and through the movable linkage to upper seat frame 52 and from there to lower backrest frame 120. The depending members or legs 134 effect simultaneous proportional angular reclining movement of upper seat frame 52 and lower backrest frame 120.

As FIGS. 3, 4, 8, 9 and 14 show, upper backrest frame 122 is mounted for pivotal movement fore and aft in the direction of arrow E (FIG. 9) to various attitudes relative to lower backrest frame 120. Upper backrest frame 122 comprises a pair of laterally spaced apart side members 140 which are rigidly secured together by a pair of rigid tubular members 141 and 142 which are welded therebetween. Each side member 140 is provided with a hole 144 for receiving a pivot rod 146 which also extends through holes 148 in the side plates 124 of lower backrest frame 120 and serves to pivotally connect the frames 120 and 122 together.

A small helical biasing spring 150 is disposed on rod 146 and is connected between the upper and lower backrest frames 122 and 120 for biasing upper backrest frame 122 forwardly toward upright position and against a rod 152 of a backrest tilt locking mechanism 156. One end of spring 150 engages tube 141 on upper seat frame 122 and the other end of spring 150 engages a hole 149 in side plate 124 of lower backrest frame 120. Rod 152 moves in the direction of arrow G (FIG. 8) in response to manual movement of upper backrest frame 122. Backrest tilt locking mechanism 156, which is a commercially available component, is selectively operable to releasably lock upper backrest frame 122 in any position into which it is moved relative to lower backrest frame 120. Mechanism 156 comprises a housing 158 connected by a pivot pin 160 between a side plate 124 of lower backrest frame 120 and a rigid support arm 125 welded on an end of tube 126. The axis of pivot pin 160 is displaced downwardly from the axis of pivot rod 146. The adjustably movable (extendable and retractable) rod 152 extends from housing 158 and is connected to the relatively movable upper backrest frame 122 by a pin 164. A manually operable locking mechanism, including a rotatable rod 166 to which a manually operable lever 167 is affixed, is mounted on housing 158 and is connected to lock or unlock rod 152 so that it can be extended or retracted in response to manual tilting movement of upper backrest frame 122 relative, to lower backrest frame 120 (see FIG. 9) to desired tilt positions. When lever 167, which is internally biased into locked position by means (not shown) within housing 158, is manually moved to unlocked position, upper backrest frame 122 can be tilted.

Figure 17:
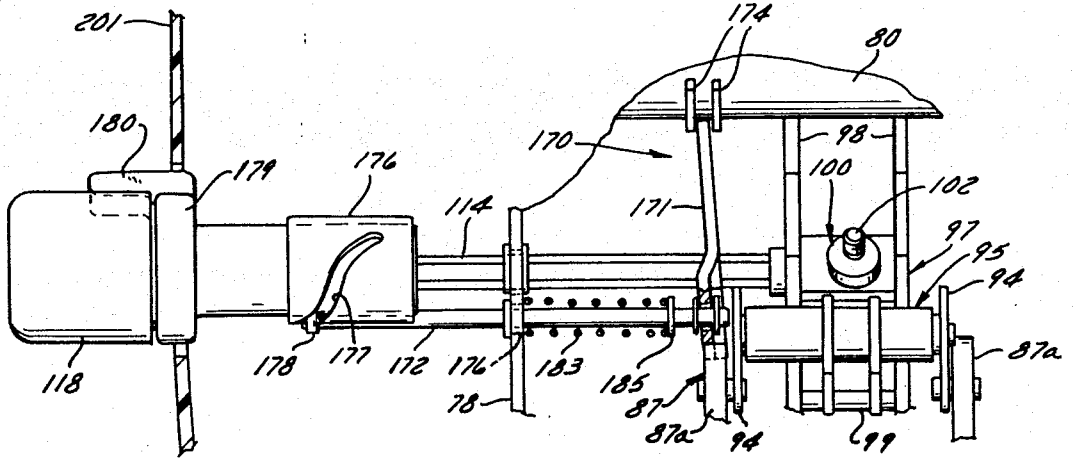
FIG. 17 is an enlarged top plan view of the spring bias force adjustment mechanism shown in FIG. 4.
Figure 18:
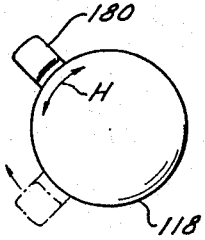
FIG. 18 is an end view of the operating knob of the mechanism of FIG. 17.

As FIGS. 4, 9, 17 and 18 show, a lockout mechanism 170 is provided to selectively prevent or permit reclining motion of backrest assembly 16 and upper seat frame 52 of seat assembly 14. Mechanism 170 comprises a movable lockout plate 171 and a manually operable control rod 172 therefor. Lockout plate 171 has one end movably engaged by entrapment between two projections 174 on tube 80 of upper seat frame 52 and has its other end selectively movable into and out of engagement with bell crank 87 by means of the manually operable axially movable rod 172 which is slidably mounted in a hole 176 in side member 78 of upper seat frame 52. Engagement of lockout plate 171 with bell crank 87 prevents bell crank rotation in response to downward force imposed on seat assembly 14 or in response to attempted reclining motion of backrest assembly 16. As FIGS. 4, 17 and 18 show, axial movement of rod 172 is effected by axial movement of a cylinder cam 176 which is fixedly mounted on the outer end of rod 172. Cylinder cam 176 is provided with a helical cam slot 177 therein which slidably engages a cam follower projection 178. Projection 178 extends outwardly from a sleeve 179 which is rotatably mounted on knob 118 which is rigidly secured to rotatable rod 114. Cylinder cam 176 and rod 172 move axially when sleeve 179 is rotated by lever 180. Sleeve 179 and the attached lever 180 can to be rotated 90° in the direction of arrow H (FIG. 18) between two positions so as to cause rod 172 to move axially toward and away from bell crank 87 and effect corresponding movement of the lower end of lockout plate 171. A helical compression spring 183 is disposed on rod 172 between left side plate 78 of upper seat frame 52 and a flange 185 on rod 172. Spring 183 biases rod 172, lockout plate and knob 179 toward lockout position.

The manual controls for adjusting height adjustment, seat pan attitude, backrest tilt, spring force adjustment and lockout are located on seat assembly 14 so as to be conveniently accessible to the chair occupant. More specifically, as FIGS. 1 and 2 show, the exterior of chair 10 is provided with rigid plastic or fiberglass shell-like covers or panels which are rigidly secured to portions of the seat framework and to the backrest framework, along with suitable upholstery panels to conceal the framework and associated mechanisms, to prevent the occupant's clothing from catching on projections, and for aesthetic purposes. In particular, seat assembly 14 is provided with a panel having two panel sides 200 and 201 (see FIG. 4) on opposite lateral sides thereof which are understood to be rigidly secured to and movable with movable upper seat frame 52 by attachment means (not shown). Seat assembly 14 is also provided with a flexible upholstery panel 204 which is attached to seat pan 54.

By maually grasping the front edge of upholstery panel 204 and the front edge of seat pan 54 therebeneath, the occupant is able to adjust the attitude of seat pan 54 and it is unnecessary for the occupant to have access to latch 56 which operates automatically in response to such movement.

Panel 200 on the occupant's left side of seat assembly 14 is provided with an access hole 206 (FIGS. 1, 2 and 4) through which projects rotatable lever 167 for backrest tilt locking.

Panel 201 on the occupant's right side of seat assembly 14 is provided with an access hole 208 (FIG. 4) through which projects vertically movable lever 42 for seat height adjustment.

Panel 201 is also provided with an access hole 210 (FIG. 4) through which projects rotatable knob 118 for tension adjustment and rotatable lever 180 for lockout of reclining motion.

We claim:

1. A chair comprising:

a base assembly (12);

a seat assembly (14);

a backrest assembly (16);

connecting,means to enable movement of at least one of said seat assembly (14) and said backrest assembly (16) from one position to another position relative to said base assembly (12) in response to force exerted by a chair occupant;

means to apply a biasing force to bias said one assembly (14,16) toward said one position and against the force exerted by said chair occupant during movement of said one assembly (14,16) from said one position to said another position, said means comprising:

at least one preloaded biasing spring (76) connected to said base assembly (12) and which is preloaded to exert a predetermined biasing force, and force transmitting means (87, 94, 95) connected to said biasing spring (76) and to said one assembly (14, 16) for transmitting biasing force from said preloaded biasing spring (76) to said one assembly (14, 16);

and adjustable means (97, 100) operable upon said force transmitting means (87, 94, 95) to change the biasing force acting on said one assembly (14, 16) without changing said predetermined biasing force exerted by said biased spring (76).

2. A chair according to claim 1 wherein said force transmitting means comprises:

movable means (87, 94, 95);

and wherein said adjustable means (97, 100) is operable to reposition said movable means to thereby change the biasing force applied to said one assembly (14, 16) without changing said predetermined biasing force exerted by said biasing spring (76).

3. A chair according to claim 1 or 2 where in said connecting means enables movement of both said seat assembly (14) and said backrest assembly (16) and wherein said force transmitting means applies said biasing force to both assemblies (14, 16).

4. A chair according to claim 3 wherein said connecting means includes means whereby the movement of said backrest assembly (16) is proportional to and at a different rate than the movement of said seat assembly (14).

5. An adjustable chair (10) comprising:

a base assembly (12);

a seat assembly (14) mounted on said base assembly (12) and comprising a seat framework including a lower seat frame (50) and an upper seat frame (52) pivotally mounted on said lower seat frame (50);

a backrest assembly (16) comprising a lower backrest framework pivotally connected to said upper seat frame (52);

and means to enable downward pivoting motion of said upper seat frame (52) and simultaneous rearward pivoting motion of said backrest frame relative to said upper seat frame (52) in response to a reclining force exerted by a chair occupant, said means comprising:

a bell crank (87) pivotally mounted on said lower seat frame (50) at a pivot point (92, 89);

at least one preloaded biasing spring (76) connected between said lower seat frame (50) and said bell crank (87) to bias said bell crank (87) in one direction, a linkage (94, 95, 100) connected between said upper seat frame (52) and said bell crank (87) to oppose the bias imposed on said bell crank (87);

at least one depending member (134) rigidly connected to said backrest framework;

and means (136, 89) for pivotally and slidably connecting said depending member (134) to said lower seat frame (50) near said pivot point (92, 89) of said bell crank (87).

6. An adjustable chair (10) according to claim 5 wherein said downward pivoting motion of said upper seat frame (52) is less than but proportional to said rearward pivoting motion of said backrest framework.

7. An adjustable chair (10) according to claim 5 including adjusting means (100) in said linkage (94, 95, 100) to adjust the force required to effect motion of said upper seat frame (52) and to said backrest framework against the bias applied by said biasing spring (72).

8. An adjustable chair (10) according to claim 7 wherein said linkage comprises at least one first link (94) and a second link (95) interconnected with each other and wherein said adjusting means (100) to adjust said linkage comprises a member (102) connected to one (95) of said links (94, 95) and movable to effect repositioning of said links (94, 95) relative to said bell crank (87) to change the effective moment arm and stroke of said bell crank (87) thereby increasing or decreasing the spring biasing force acting on said upper seat frame (52) and on said backrest framework without changing the initial preloading of said spring (76), thereby reducing the force required to adjust the spring biasing;

and means operable to effect movement of said member (102).

9. An adjustable chair (10) according to claim 8 wherein said member (102) of said adjusting means (100) comprises a screw (102) connected to said second link (95) of said pair of links (94, 95);

a rotatable threaded member (110) rotatably mounted on said upper seat frame (52) and threadedly engaged with said screw (102);

and manually operable means (112, 114) to effect rotation of said threaded member (110) and thereby effect movement of said second link (95) to a selected position relative to said first link (94).

10. An adjustable chair (10) according to claim 9 wherein said rotatable threaded member (110) comprises a first gear (110), and wherein said manually operable means comprises a second gear (112) which is meshed with said first gear (110) and a rotatable rod (114) connected to effect rotation of said gears.

11. An adjustable chair (10) according to claims 5 or 7 including lockout means selectively operable to prevent rotation of said bell crank to thereby prevent movement of said upper seat frame and movement of said backrest framework.

12. An adjustable chair (10) according to claim 11 wherein said lockout means includes movable means (171) connected to said upper seat frame (52) and selectively movable into and out of engagement with said bell crank (87) to prevent or permit, respectively, rotation of said bell crank (87), motion of said backrest framework and motion of said upper seat frame (52).

13. An adjustable chair (10) according to claim 12 wherein said lockout means further comprises:

an actuator rod (172) mounted for axial movement on said upper seat frame (52) and connected to effect movement of said movable means (171) into and out of engagement with said bell crank to prevent bell crank rotation when engaged;

and manually operable means to effect axial movement of said actuator rod.

14. An adjustable chair (10) according to claim 13 wherein said manually operable means of said lockout means comprises:

a cam cylinder (176) rigidly mounted on said actuator rod (172);

a manually rotatable sleeve (179) rotatably mounted relative to said upper seat frame (52);

and a helical cam (177) on said cam cylinder (176) and engaged with a cam follower (178) on said rotatable sleeve (179) to effect axial movement of said actuator rod (172) in response to manual rotational movement of said rotatable sleeve (179).

15. An adjustable chair (10) according to claim 5 wherein said seat assembly (14) comprises a seat pan (54) which is pivotally mounted on said upper seat frame (52) and is movable to a plurality of tilt attitudes and wherein said seat assembly (14) further comprises means (56) connected between said upper seat frame (52) and said seat pan (54) to releasably latch said seat pan (54) in a selected tilt attitude.

16. An adjustable chair (10) according to claim 5 wherein said backrest framework of said backrest assembly (16) comprises a lower backrest frame (120) and an upper backrest frame (122) pivotally mounted on said lower backrest frame (120) to enable said upper backrest frame (122) to be movable relative to said lower backrest frame (120) to a plurality of backrest tilt positions;

and means (156) connected between said lower backrest frame (120) and said upper backrest frame (122) and selectively operable to releasably maintain said upper backrest frame (122) in a selected backrest tilt position.

17. An adjustable chair (10) according to claim 5 including actuator means (24) connected between said base assembly (12) and said lower seat frame (50) of said seat assembly (14) to effect raising and lowering of said seat assembly (14).

18. An adjustable chair (10) comprising:

a base assembly (12);

a seat assembly (14) comprising a framework and a movable seat pan (54) adjustably mounted on said framework;

and means to raise and lower said seat assembly relative to said base assembly comprising:

a pneumatic actuator (24) mounted between said base assembly (12) and said seat assembly (14) and comprising a cylinder (26), an extendable and retractable piston rod (28), a selectively operable valve (30) within said pneumatic actuator (24), and a valve stem (40) extending outwardly of said pneumatic actuator (24);

and means to selectively operate said valve (30) comprising:

a manually operable lever (42) movably mounted on said seat pan (54);

a bell crank (46) pivotally mounted on said framework of said seat assembly (14) and connected to said valve stem (40);

and an axially movable actuator rod (44) connected between said lever (42) and said bell crank (46).

19. An adjustable chair (10) comprising:

a base assembly (12);

a seat assembly (14) mounted on said base assembly (12);

a backrest assembly (16) comprising a lower backrest frame (120) connected to said seat assembly (14) and an upper backrest frame (122) pivotally mounted on said lower backrest frame (120);

and means to move said upper backrest frame (122) fore and aft relative to said lower backrest frame (122) to desired tilt positions comprising:

a mechanism (156) mounted between said lower backrest frame (120) and said upper backrest frame (122) and comprising a housing (158) pivotally mounted on said lower backrest frame (120), an axially movable rod (152) extending from said housing (158) and pivotally connected to said upper backrest frame (122), a manually rotatable member (166) on said housing (158) for operating means in said housing to releasably maintain said rod in an axial position into which it is moved or to enable extension or retraction of said rod.

20. A chair comprising:

a base assembly (12);

a seat assembly (14);

a backrest assembly (16);

connecting means to enable movement of at least one of said seat assembly (14) and said backrest assembly (16) from one position to another position relative to said base assembly (12) in response to force exerted by a chair occupant;

and means to apply a biasing force to bias said one assembly (14, 16) toward said one position and against the force exerted by said chair occupant during movement of said one assembly (14, 16) from said one position to said another position, said means comprising:

at least one preloaded biasing spring (76) which is preloaded to exert a predetermined biasing force;

and means (87, 94, 95, 100) for transmitting biasing force from said preloaded biasing spring (76) to said one assembly (14, 16), said means for transmitting biasing force from said preloaded biasing spring (76) being adjustable to change the biasing force acting on said one assembly (14, 16) without changing said predetermined biasing force exerted by said biasing spring (76), said means for transmitting biasing force from said preloaded biasing spring (76) to said one assembly (14, 16) comprising:

a pivotally movable bell crank (87);

a movable linkage (95, 94) connected to said bell crank (87);

and adjustable means operable to reposition said linkage (95, 94) relative to said bell crank (87) to thereby change the effective moment arm and stroke of said bell crank (87) without changing said predetermined biasing force exerted by said biasing spring.

21. A chair according to claim 20 wherein said connecting means enables movement of both said seat assembly (14) and said backrest assembly (16).

22. A chair according to claim 21 wherein the movement of said backrest assembly (16) is proportional to the movement of said seat assembly (14).

* * * * *